US009897053B2

(12) United States Patent
Kolhouse et al.

(10) Patent No.: US 9,897,053 B2
(45) Date of Patent: Feb. 20, 2018

(54) FUEL COOLED INJECTOR TIP

(71) Applicant: Cummins Inc., Columbus, IN (US)

(72) Inventors: Steven J. Kolhouse, Columbus, IN (US); Raymond V. Primus, Indianapolis, IN (US); Lester L. Peters, Columbus, IN (US); David L. Buchanan, Westport, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 15/235,189

(22) Filed: Aug. 12, 2016

(65) Prior Publication Data

US 2017/0045023 A1 Feb. 16, 2017

Related U.S. Application Data

(60) Provisional application No. 62/204,254, filed on Aug. 12, 2015.

(51) Int. Cl.

| | |
|---|---|
| ***F02M 53/04*** | (2006.01) |
| ***F02D 41/04*** | (2006.01) |
| ***F02M 61/18*** | (2006.01) |
| ***F02M 37/00*** | (2006.01) |
| ***F02D 41/38*** | (2006.01) |
| ***F02D 41/08*** | (2006.01) |

(52) U.S. Cl.

CPC ..... *F02M 53/043* (2013.01); *F02D 41/042* (2013.01); *F02M 37/0052* (2013.01); *F02M 61/18* (2013.01); *F02D 41/08* (2013.01); *F02D 41/3854* (2013.01); *F02D 2041/3881* (2013.01); *F02D 2200/0602* (2013.01); *F02D 2200/0606* (2013.01)

(58) Field of Classification Search

CPC .. F02M 53/043; F02M 37/0052; F02M 61/18; F02M 55/00; F02M 55/001; F02M 55/002; F02M 55/008; F02M 55/02; F02M 55/025; F02D 2200/0606; F02D 2200/0602; F02D 2041/3881; F02D 41/3854; F02D 41/08; B05B 1/24

USPC ..... 123/445

See application file for complete search history.

(56) References Cited

U.S. PATENT DOCUMENTS

| | | | | |
|---|---|---|---|---|
| 5,076,236 | A * | 12/1991 | Yu | F02M 57/021 123/446 |
| 5,291,869 | A | 3/1994 | Bennett | |
| 5,379,740 | A | 1/1995 | Moore et al. | |
| 7,090,145 | B2 | 8/2006 | Baker et al. | |
| 7,506,638 | B2 | 3/2009 | Shinkarenko et al. | |
| 7,849,836 | B2 | 12/2010 | Chang | |
| 7,963,461 | B2 | 6/2011 | Kothen et al. | |

(Continued)

*Primary Examiner* — Joseph Dallo
*Assistant Examiner* — Scott A Reinbold
(74) *Attorney, Agent, or Firm* — Faegre Baker Daniels LLP

(57) ABSTRACT

A fuel injector is provided comprising an outer housing, a nozzle housing disposed within the outer housing, a flow path between the outer housing and the nozzle housing, the flow path being coupled to a low pressure fuel source, and a circumferential gap in flow communication with the flow path and extending about a tip of the fuel injector between an outer surface of the nozzle housing and an inner surface of a combustion shield adjacent the injector tip. The circumferential gap is in flow communication with a drain gap between the outer housing and a bore for receiving the fuel injector, the drain gap routing the low pressure fuel away from the injector tip.

23 Claims, 5 Drawing Sheets

(56) References Cited

U.S. PATENT DOCUMENTS

| | | | | |
|---|---|---|---|---|
| 2004/0211846 | A1* | 10/2004 | Chenanda | F02M 53/043 239/132.5 |
| 2008/0017169 | A1* | 1/2008 | Hlousek | F02M 47/027 123/456 |
| 2010/0030456 | A1* | 2/2010 | Chominsky | F02D 41/08 701/112 |
| 2010/0084489 | A1* | 4/2010 | Chang | F02M 47/027 239/132 |
| 2010/0288850 | A1* | 11/2010 | Ibrahim | F02M 53/043 239/132 |
| 2011/0214643 | A1* | 9/2011 | Blizard | F02M 53/02 123/468 |
| 2012/0037124 | A1* | 2/2012 | Peters | F01P 3/16 123/470 |
| 2012/0325926 | A1* | 12/2012 | Moore | F02M 63/0071 239/5 |
| 2014/0116390 | A1 | 5/2014 | Foege | |

* cited by examiner

FUEL COOLED INJECTOR TIP

CROSS-REFERENCE TO RELATED APPLICATIONS

This application claims priority to U.S. Provisional Application Ser. No. 62/204,254, entitled "FUEL COOLED INJECTOR TIP," filed on Aug. 12, 2015, the entire disclosure of which is hereby expressly incorporated herein by reference.

TECHNICAL FIELD

The present invention relates generally to fuel injectors and more particularly to embodiments of a fuel injector having a tip cooled by low pressure fuel.

BACKGROUND

Diesel Dual Fuel ("DDF") is a technology wherein a combination of methane or other natural gas and diesel is used in a compression ignited engine, thereby maintaining the high compression ratio of a diesel engine with the resulting benefits of thermal efficiency. However, the tip of the fuel injector may reach intolerable temperatures in DDF engines as a result of reduced diesel fuel flow through the injector. In dual fuel operation, as opposed to diesel operation, high loads do not necessarily imply a high flow of diesel through the injector nozzle. Accordingly, an approach is needed for reducing the temperature of fuel injector nozzle tips, especially during high load dual fuel operation.

SUMMARY

According to one embodiment, the present disclosure provides a fuel injector, comprising: an outer housing; a nozzle housing disposed within the outer housing; a flow path between the outer housing and the nozzle housing, the flow path being coupled to a low pressure fuel source; and a circumferential gap in flow communication with the flow path and extending about a tip of the fuel injector between an outer surface of the nozzle housing and an inner surface of a combustion shield adjacent the injector tip; wherein the circumferential gap is in flow communication with a drain gap between the outer housing and a bore for receiving the fuel injector, the drain gap routing the low pressure fuel away from the injector tip. In one aspect of this embodiment, the outer surface of the nozzle housing includes a first shoulder that contacts the combustion shield to define one end of the circumferential gap, and a second shoulder that contacts the combustion shield to define another end of the circumferential gap, the other end of the circumferential gap having an opening in flow communication with the flow path. In a variant of this aspect, the drain gap is in flow communication with the circumferential gap at a location between the ends of the circumferential gap. In another aspect, the nozzle housing comprises at least one injector orifice positioned at a distal end of the nozzle housing, the injector orifice being in flow communication with a high pressure fuel source to controllably inject fuel into a cylinder of an engine. Still another aspect further comprises an O-ring disposed between the outer housing and the bore, the drain gap being disposed between the injector tip and the O-ring.

In another embodiment, the present disclosure provides a method for cooling a fuel injector in a dual fuel engine application, comprising: providing low pressure diesel fuel to a double walled segment coupled to a plurality of fuel injectors; routing the low pressure diesel fuel from the double walled segment through a flow path between an injector nozzle housing and an injector outer housing; routing the low pressure diesel fuel from the flow path through a circumferential gap extending about a tip of the fuel injector between an outer surface of the injector nozzle housing and an inner surface of a combustion shield adjacent the injector tip; and draining the low pressure diesel fuel from the circumferential gap through a drain line coupled to a fuel tank. In one aspect of this embodiment, routing the low pressure diesel fuel from the flow path through a circumferential gap comprises routing the low pressure fuel through an opening defined at one end of the circumferential gap by a shoulder of the outer surface of the nozzle housing and an inner surface of the combustion shield. In another aspect, the drain line is in flow communication with the circumferential gap at a location between ends of the circumferential gap.

In yet another embodiment, the present disclosure provides a fuel injector, comprising: an outer housing; a nozzle housing disposed within the outer housing; a flow path between the outer housing and the nozzle housing, the flow path being coupled to a low pressure fuel source; a circumferential gap in flow communication with the flow path and extending along an upper surface of a combustion shield adjacent the injector tip; and an opening extending through the outer housing having one end in flow communication with the circumferential gap and another end in flow communication with a drain gap formed between the outer housing and a bore for receiving the fuel injector, the drain gap routing the low pressure fuel away from the injector tip. In one aspect of this embodiment, the nozzle housing comprises at least one injector orifice positioned at a distal end of the nozzle housing, the injector orifice being in flow communication with a high pressure fuel source to controllably inject fuel into a cylinder of an engine. Another aspect further comprises an O-ring disposed between the outer housing and the bore, the drain gap being disposed between the injector tip and the O-ring.

In still another embodiment, the present disclosure provides a method for cooling a fuel injector in a dual fuel engine application, comprising: providing low pressure diesel fuel to a double walled segment coupled to a plurality of fuel injectors; routing the low pressure diesel fuel from the double walled segment through a flow path between an injector nozzle housing and an injector outer housing; routing the low pressure diesel fuel from the flow path through a circumferential gap extending along an upper surface of a combustion shield adjacent an injector tip; and draining the low pressure diesel fuel from the circumferential gap through a drain line coupled to a fuel tank. In one aspect of this embodiment, providing low pressure diesel fuel to a double walled segment comprises providing the low pressure fuel to an outer line of the double walled segment surrounding an inner line of the double walled segment. A variant of this aspect further comprises providing high pressure fuel to the inner line of the double walled segment. In another aspect, routing the low pressure diesel fuel from the double walled segment through a flow path comprises routing the low pressure fuel from the double walled segment through a T-fitting coupled to one of the plurality of fuel injectors. Another aspect further comprises using a control module to control operation of the plurality of fuel injectors. In a variant of this aspect, using a control module to control operation of the plurality of fuel injectors comprises responding to an engine shut down when a fuel injector operating temperature is above a predetermined high temperature threshold by causing the flow of low pressure diesel fuel to the plurality of fuel injectors to discontinue. In another variant, using a control module to control operation of the plurality of fuel injectors comprises responding to an engine shut down when a fuel injector operating temperature is above a predetermined high temperature threshold by activating a pumping device coupled to the circumferential gap to pump low pressure diesel fuel from the circumferential gap. In yet another variant, using a control module to control operation of the plurality of fuel injectors comprises responding to an engine shut down when a fuel injector operating temperature is above a predetermined high temperature threshold by activating a pump for a period of time following engine shut down to pump low pressure diesel fuel through the circumferential gap to cool the injector tip. In still another variant, using a control module to control operation of the plurality of fuel injectors comprises responding to an engine shut down when a fuel injector operating temperature is above a predetermined high temperature threshold by causing the engine to idle for a period of time prior to actually shutting down the engine to permit the plurality of fuel injectors to cool before shut down. In a further variant, the period of time is one of a predetermined period of time or a period of time that depends upon a difference between the fuel injector operating temperature and the predetermined high temperature threshold.

In still another embodiment, the present disclosure provides a method for cooling a fuel injector, comprising: using a control module to respond to an engine shut down when an operating temperature of a fuel injector of an engine is above a high temperature threshold by causing the engine to idle for a period of time prior to actually shutting down the engine to permit the fuel injector to cool before shut down. In one aspect of this embodiment, the period of time is one of a predetermined period of time or a period of time that depends upon a difference between the operating temperature and the high temperature threshold.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
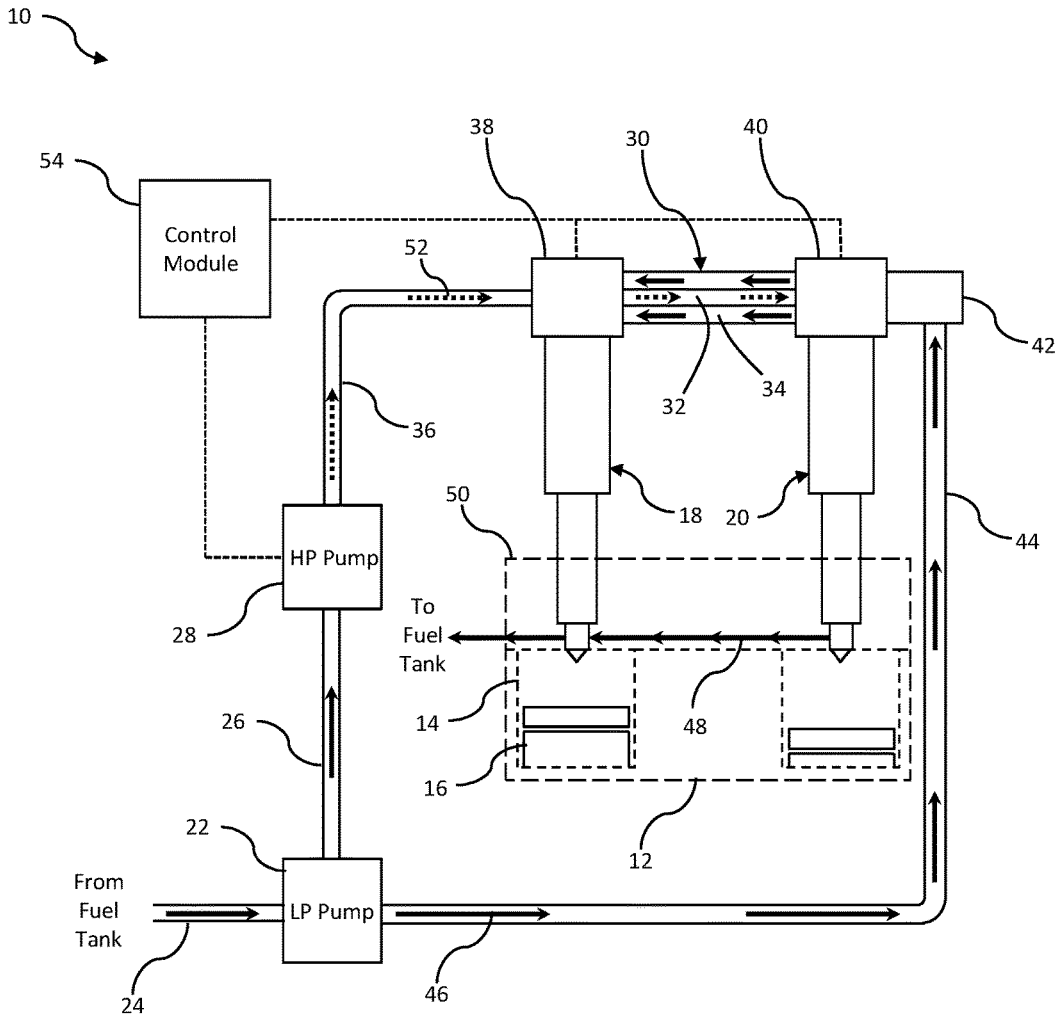
FIG. 1 is a schematic diagram of a fuel delivery system for an engine.

While the present disclosure is amenable to various modifications and alternative forms, specific embodiments have been shown by way of example in the drawings and are described in detail below. The present disclosure, however, is not to limit the particular embodiments described. On the contrary, the present disclosure is intended to cover all modifications, equivalents, and alternatives falling within the scope of the appended claims.

DETAILED DESCRIPTION

Methods and apparatuses for reducing the temperature of fuel injector nozzle tips are described below. It should be understood that by reducing the nozzle tip temperature in dual fuel applications, a reduced amount of diesel pilot fuel may be used in fuel injection events, thereby permitting an increased substitution ratio (i.e., the amount of fuel energy supplied by gas divided by the total fuel energy). In conventional approaches, reduced diesel pilot fuel resulted in higher operating temperature of the fuel injector tip (due to the increased percentage of natural gas used during combustion). This higher temperature resulted in, among other things, increased carboning of fuel injector spray holes. The present disclosure permits lower quantities of diesel pilot in dual fuel engines with reduced concern of carboning because of the reduced operating temperature of the fuel injectors. It should be understood, however, that the principles of the present disclosure may also be adapted by skilled artisans for use in other engine applications, including conventional (i.e., non-dual fuel) diesel engines.

Referring now to FIG. 1, an embodiment of a fuel supply system 10 configured to cool the tips of fuel injectors is shown coupled to an internal combustion engine 12 including a plurality of cylinders 14, each housing a piston 16 that is movable in a reciprocating manner within its associated cylinder 14 as is known in the art. Fuel system 10 is a common rail configuration that supplies fuel to each of a plurality of daisy chained fuel injectors 18, 20 (only two shown), each of which is controlled to deliver timed charges of atomized fuel under high pressure to an associated one of cylinders 14.

As shown in FIG. 1, fuel system 10 includes a low pressure ("LP") fuel pump 22 that draws fuel from a fuel tank or reservoir (not shown) through a low pressure fuel line 24. One fuel output from LP pump 22 may be passed through a filter (not shown) before being provided through conduit 26 to a high pressure ("HP") fuel pump 28, which provides fuel at high pressure to fuel injectors 18, 20 as is further described below.

In this embodiment, injectors 18, 20 are coupled together by a double walled segment 30 which includes an inner line 32 that forms a portion of a high pressure fuel passage, and an outer line 34 surrounding the inner line 32 to form an annular shaped low pressure fuel passage. As will be described below in detail, cool low pressure fuel may be provided to injectors 18, 20 through outer line 34 to cool the tips of fuel injectors 18, 20.

As shown in FIG. 1, double walled segment 30 has one end sealingly connected to a T-fitting 38 coupled to fuel injector 18 and another end sealingly connected to a T-fitting 40 coupled to fuel injector 20. T-fitting 38 is coupled to a high pressure fuel line 36 coupled as an output of HP fuel pump 28. In this way, a continuous supply of high pressure fuel 52 is provided in the direction of dash tailed arrows depicted in FIG. 1 from high pressure fuel line 36 of HP fuel pump 28 through inner line 32 of double walled segment 30 to the last fuel injector 20 in the plurality of fuel injectors. In the depicted embodiment, inner line 32 is terminated at an outlet of T-fitting 40 of fuel injector 20 with a coupler 42.

Coupler 42 is also connected to a low pressure fuel line 44 from LP pump 22. After the low pressure fuel 46 from LP pump 22 enters coupler 42, it flows through outer line 34 of double walled segment 30 in the direction of solid tailed arrows depicted in FIG. 1 to T-fitting 38. The low pressure fuel is also routed through fuel injectors 18, 20 to cool the tips of the injectors as is described in detail below. The low pressure fuel exits fuel injectors 18, 20 through drain line 48 formed in cylinder head 50, and is drained back to the fuel tank (not shown).

It should be understood by those skilled in the art with the benefit of the present disclosure that instead of providing high pressure fuel through line 36 to T-fitting 38 and low pressure fuel to coupler 42, high pressure pump 28 could readily provide both high pressure fuel and low pressure fuel to T-fitting 38 via a double walled segment, thereby eliminating the need for line 44.

As indicated by the dashed lines in FIG. 1, the operation of HP pump 28 and fuel injectors 18, 20 to provide timed and measured amounts of fuel to cylinders 14 is controlled by control module 54, such as an engine control module ("ECM"). Control module 54 can sense several conditions of the engine 12 and fuel system 10, including but not limited to sensing pressure and/or temperature of fuel in HP pump 28 and double walled segment 30, and can control fuel injectors 18, 20 in response to these sensed conditions. It should be understood that while control module 54 is depicted as a single physical device, control module 54 may be implemented as multiple distributed devices without deviating from the principles of the present disclosure.

In certain embodiments, control module 54 includes one or more modules that functionally execute the operations of the control module. The description herein including modules emphasizes the structural independence of certain aspects of control module 54, and illustrates one grouping of operations and responsibilities of the control module. Other groupings that execute similar overall operations are understood within the scope of the present disclosure. Modules may be implemented in hardware and/or as computer instructions on a non-transient computer readable storage medium, and modules may be distributed across various hardware or computer based components.

Figure 2:
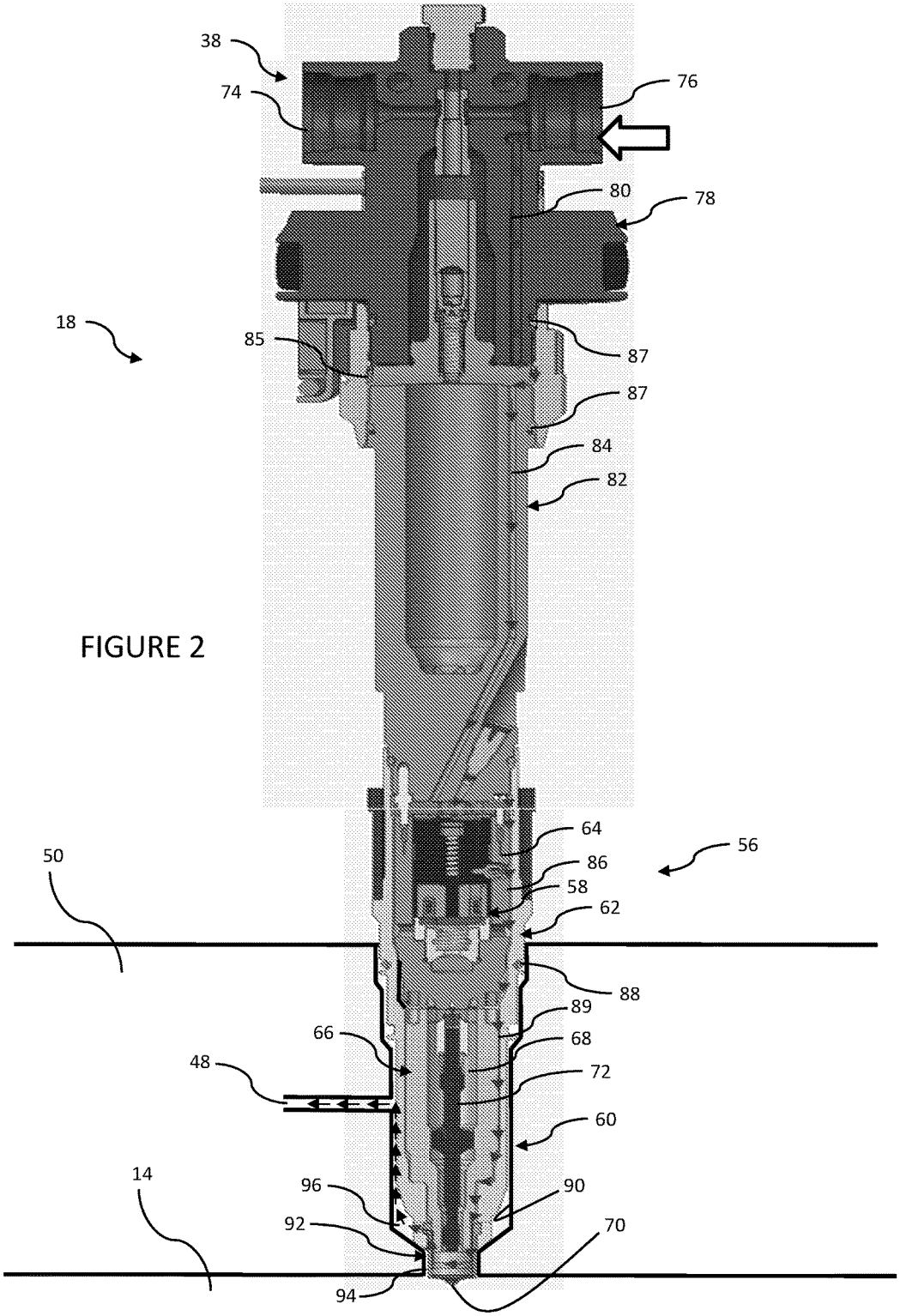
FIG. 2 is a cross-sectional side view of a fuel injector according to the principles of the present disclosure.

FIG. 2 provides a detailed cross-sectional view of a fuel injector according to embodiments of the present disclosure, such as fuel injector 18. As shown, fuel injector 18 includes an injector body 56 which includes an injection control valve assembly 58, a nozzle module 60, an outer housing 62, and a valve housing 64. Outer housing 62 secures injection control valve assembly 58, nozzle module 60 and other elements of fuel injector 18 in a fixed relationship. The structural and functional details of fuel injector 18 may be similar to those disclosed in U.S. Pat. Nos. 5,676,114 and 7,156,368, the entire disclosures of which are expressly incorporated herein by reference.

Nozzle module 60 includes a nozzle housing 66 positioned in outer housing 62 and an injector cavity 68 located within nozzle housing 66. Nozzle housing 66 further includes one or more injector orifices 70 positioned at a distal end of nozzle housing 66. Injector orifices 70 communicate with one end of injector cavity 68 to discharge high pressure fuel into the cylinder 14 of engine 12. Nozzle module 60 further includes a nozzle or nozzle valve element 72 positioned in injector cavity 68 adjacent to injector orifices 70. Nozzle valve element 72 is movable between an open position which denotes the beginning of an injection event because fuel may flow through injector orifices 70 into the cylinder 14 and a closed position which denotes the end of the injection event because fuel flow through injector orifices 70 is blocked or inhibited.

In FIG. 2, fuel injector 18 is shown coupled to T-fitting 38, which includes an opening 74, which is coupled to high pressure fuel line 36 of HP pump 28 as shown in FIG. 1, and an opening 76, which is coupled to double walled segment 30 as shown in FIG. 1. Fuel injector 18 also includes a damper flange 78 coupled to T-fitting 38 which includes a drilling 80. Drilling 80 extends through damper flange 78 to opening 76 so that the cooling fuel from double walled segment 30 is routed into fuel injector 18. Fuel injector 18 further includes an accumulator 82 which is coupled to damper flange 78. Accumulator 82 includes drilling 84 which is coupled at one end to drilling 80. Cooling fluid from drilling 80 is routed through a slot on a face of damper flange 78, into an annular gap 85 and then across a slot at an upper end of accumulator 82. O-rings 87 on damper flange 78 and accumulator 82 prevent leakage of the fuel from the annular gap 85. Drilling 84 is coupled at its other end to a circumferential gap 86 between outer housing 62 and valve housing 64.

Figure 3:
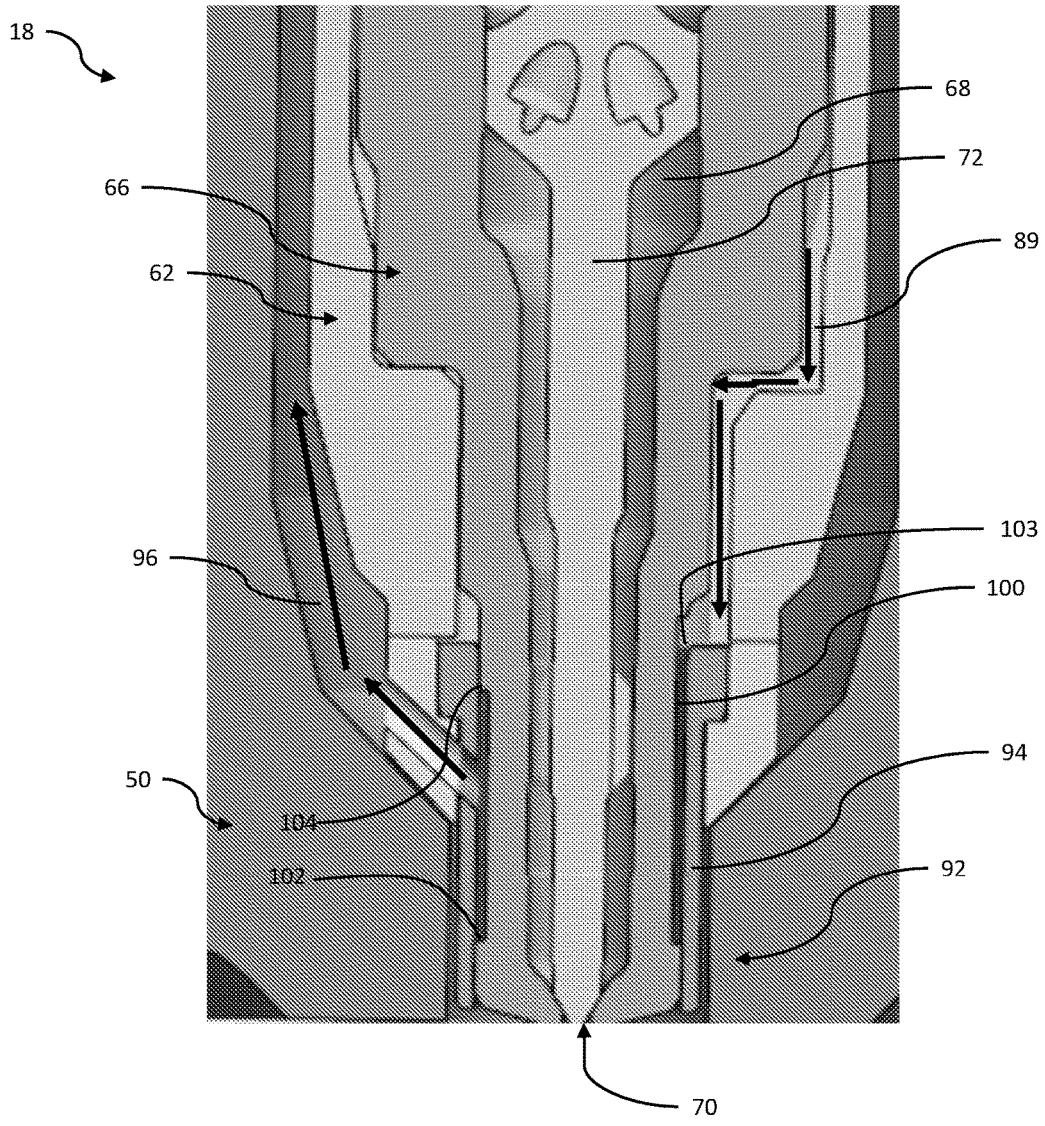
FIG. 3 is an enlarged cross-sectional side view of a portion of the fuel injector of FIG. 2.

Referring now to FIGS. 2 and 3, gap 86 permits low pressure fuel to flow along a flow path 89 between nozzle housing 66 and outer housing 62. As described in more detail below, low pressure fuel is routed to injector tip 92 where it flows in contact with a nozzle combustion shield 94 to absorb heat from shield 94 and cool nozzle tip 92. The fuel is then routed to a drain gap 96 between outer housing 62 and an injector bore 90 formed in cylinder head 50 to common injector drain line 48, which is in fluid communication with the fuel tank (not shown). Low pressure fuel is prevented from flowing out of injector bore 90 (other than through drain line 48) by an upper O-ring 88 that extends around outer housing 62 within injector bore 90.

Referring now to FIG. 3, a more detailed view of the flow of low pressure fuel to cool nozzle tip 92 is shown. As indicated by the arrows in the figure, fuel flows through flow path 89 between nozzle housing 66 and outer housing 62. As the fuel approaches nozzle tip 92, it is routed into a circumferential gap 100 extending about nozzle housing 66 between an outer surface of nozzle housing 66 and an inner surface of combustion shield 94. Gap 100 is closed at a lower end by a circumferential shoulder 102 and closed at an upper end (except at its interface—opening 103—with flow path 89) by a partially circumferential shoulder 104. As such, the only outlet from circumferential gap 100 is drain gap 96 which routes the fuel (after having absorbed heat from combustion shield 94 and nozzle housing 66) to drain line 48.

Figure 4:
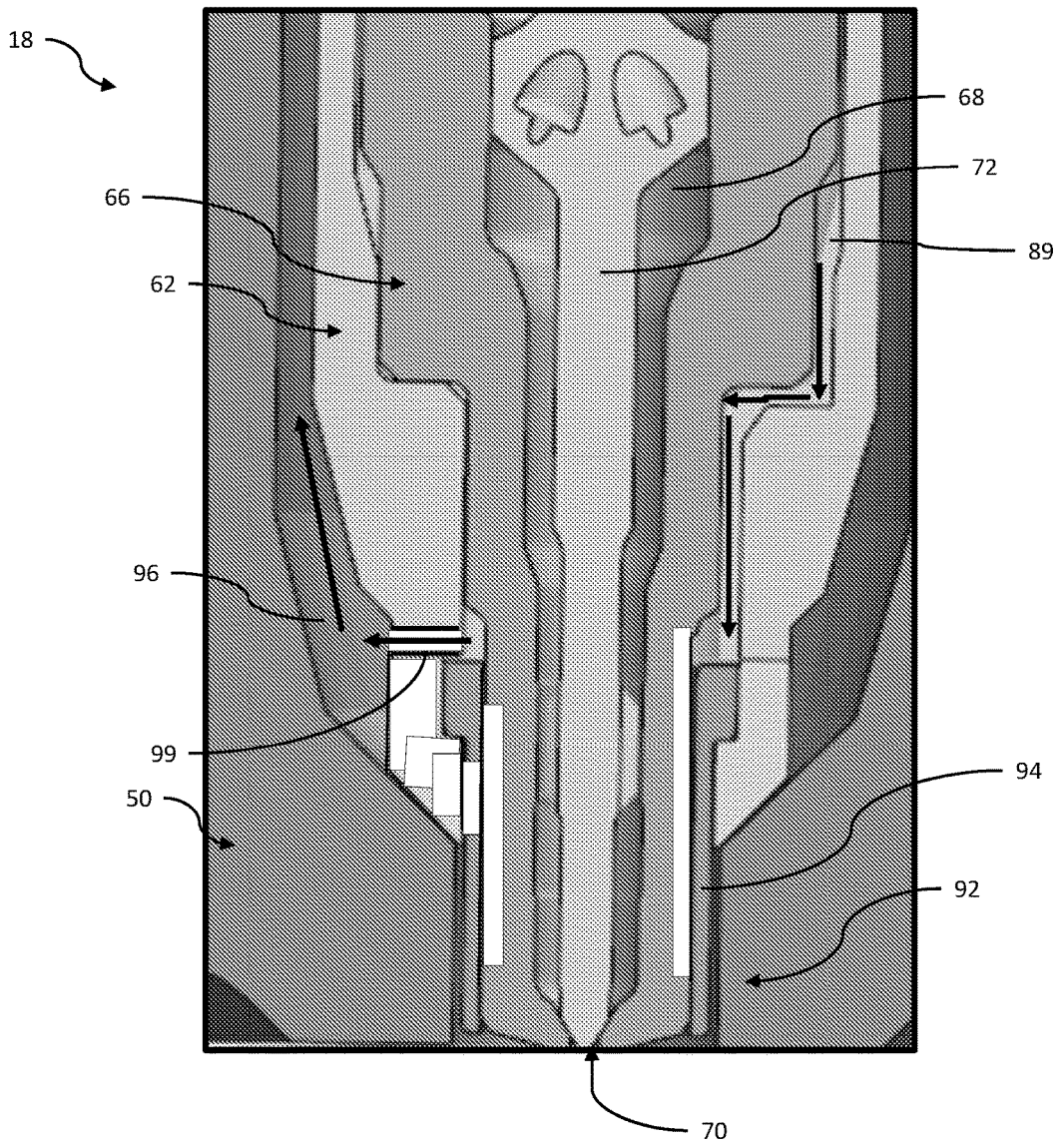
FIG. 4 is an enlarged cross-sectional side view of a portion of another embodiment of a fuel injector.

In an alternative embodiment depicted in FIG. 4, cooling fuel flows across an upper end of combustion shield 94 instead of around nozzle tip 92. As shown, outer housing 62 includes an opening 99 in flow communication with flow path 89 at one end and drain gap 96 at another end. As fuel flows along the upper end of combustion shield 94 from flow path 89 to drain gap 96, heat is transferred to the fuel from the nozzle tip 92 via the combustion shield 94.

Figure 5:
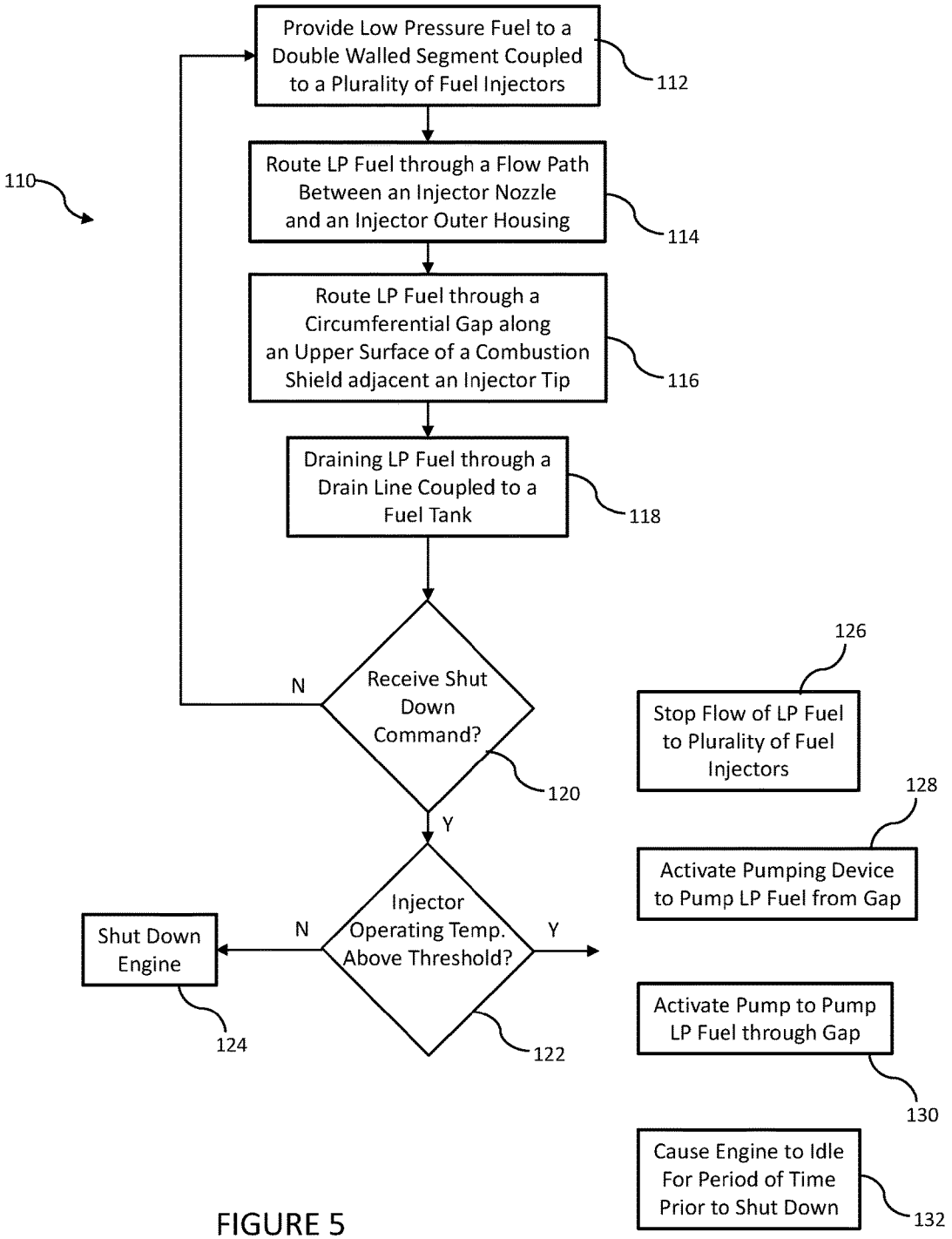
FIG. 5 is a flow chart of a method of cooling a fuel injector according to the teachings of the present disclosure.

In certain applications, the fuel injector tip is particularly susceptible to damage from fuel boiling and/or coking after high temperature engine shut down. In particular, when the engine is shut down after high temperature operation, residual fuel remaining in injector cavity 68 in the vicinity of orifices 70 may boil and/or coke, causing damage to fuel injector tip 92. FIG. 5 depicts a method for responding to a high temperature shut down situation to reduce potential damage to the fuel injector tip. As shown, method 110 includes providing low pressure diesel fuel to a double walled segment coupled to a plurality of fuel injectors at step 112. At step 114, low pressure diesel fuel is routed from the double walled segment through a flow path between an injector nozzle housing and an injector outer housing. At step 116, the low pressure diesel fuel is routed from the flow path through a circumferential gap extending along an upper surface of a combustion shield adjacent an injector tip. At step 118, the low pressure diesel fuel is drained from the circumferential gap through a drain line coupled to a fuel tank.

At step 120, control module 54 determines whether an engine shut down command has been received. If not, operation continues at step 112. If an engine shut down command has been received, control module 54 determines at step 122 whether an injector operating temperature is above a predetermined threshold. If not, control module 54 initiates an engine shut down at step 124. If control module 54 determines that the injector operating temperature is above the predetermined threshold, then depending upon the embodiment of the present disclosure implemented, control is passed to one or more of steps 126, 128, 130 or 132.

In one embodiment of the present disclosure, the low pressure fuel circulated through circumferential gap 100 (FIG. 3) is vented or drained from the fuel injector tip 92 following high temperature shut down. In particular, when control module 54 identifies a fuel injector operating temperature above a predetermined high temperature threshold, control module 54 may respond to an engine shut down by discontinuing the flow of low pressure fuel to fuel injectors 18, 20 to limit the amount of low pressure fuel adjacent fuel injector tip 92 at shut down as indicated by step 126. It should be further understood that control module 54 may instead, or in addition, activate a pumping device coupled to circumferential gap 100 through flow path 89 or drain line 48 to pump low pressure fuel from circumferential gap 100 when a high temperature shut down situation is identified as indicated by step 128. Diesel only operation will also increase the amount of fuel flowing through injector orifices 70 which cools them and prevents carboning.

Alternatively, or in addition, in other embodiments control module 54 may operate a low pressure fuel pump, such as fuel pump 22 for a period of time following high temperature shut down as indicated by step 130. In this manner, cool low pressure fuel is pumped through the above-described path around fuel injector tip 92 and out drain line 48 for a period of time to cool the fuel injector tip 92 even after the engine 12 is shut down. The time period of operation of the pump needed to prevent damage to the fuel injector tip 92 after high temperature shut down may be responsive to a model of the thermal characteristics of fuel injector 18, 20 or responsive to a sensed characteristic of the actual operation of fuel injector 18, 20, such as, for example, a sensed temperature at fuel injector tip 92 or both.

Also, control module 54 may respond to a high temperature shut down situation by modifying an engine shut down algorithm in response to shut down temperature limits and/or operating conditions preceding the shut down. Such a modification may result in an engine idle time period prior to actual shut down to permit the engine to cool before shut down as indicated by step 132. Again, the idle period may be responsive to a model or to actual sensed characteristics of engine parameters. In a modification of this embodiment, control module 54 may instead, or in addition, cause diesel only operation for some time period prior to actual shut down to cool the injector tip 92 before shut down. As is known, combustion of gas causes higher tip temperatures. Therefore, elimination of the gas fuel component (i.e., diesel only operation) will result in lower tip temperatures at shut down.

Other mechanisms and approaches for managing high temperature shut down situations are described in co-pending patent application Ser. No. 62/204,408, entitled "NOZZLE COMBUSTION SHIELD AND SEALING MEMBER WITH IMPROVED HEAT TRANSFER CAPABILITIES," filed on Aug. 12, 2015, the entire disclosure of which being expressly incorporated herein by reference.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

We claim:

1. A fuel injector, comprising:

an outer housing;

a nozzle housing disposed within the outer housing;

a flow path between the outer housing and the nozzle housing, the flow path being coupled to a low pressure fuel source; and a circumferential gap in flow communication with the flow path and extending about a tip of the fuel injector between an outer surface of the nozzle housing and an inner surface of a combustion shield adjacent the injector tip;

wherein the circumferential gap is in flow communication with a drain gap between the outer housing and a bore for receiving the fuel injector, the drain gap routing the low pressure fuel away from the injector tip.

2. The fuel injector of claim 1, wherein the outer surface of the nozzle housing includes a first shoulder that contacts the combustion shield to define one end of the circumferential gap, and a second shoulder that contacts the combustion shield to define another end of the circumferential gap, the other end of the circumferential gap having an opening in flow communication with the flow path.

3. The fuel injector of claim 2, wherein the drain gap is in flow communication with the circumferential gap at a location between the ends of the circumferential gap.

4. The fuel injector of claim 1, wherein the nozzle housing comprises at least one injector orifice positioned at a distal end of the nozzle housing, the injector orifice being in flow communication with a high pressure fuel source to controllably inject fuel into a cylinder of an engine.

5. The fuel injector of claim 1, further comprising an O-ring disposed between the outer housing and the bore, the drain gap being disposed between the injector tip and the O-ring.

6. A method for cooling a fuel injector in a dual fuel engine application, comprising:

providing low pressure diesel fuel to a double walled segment coupled to a plurality of fuel injectors;

routing the low pressure diesel fuel from the double walled segment through a flow path between an injector nozzle housing and an injector outer housing;

routing the low pressure diesel fuel from the flow path through a circumferential gap extending about a tip of the fuel injector between an outer surface of the injector nozzle housing and an inner surface of a combustion shield adjacent the injector tip; and draining the low pressure diesel fuel from the circumferential gap through a drain line coupled to a fuel tank.

7. The method of claim 6, wherein routing the low pressure diesel fuel from the flow path through a circumferential gap comprises routing the low pressure fuel through an opening defined at one end of the circumferential gap by a shoulder of the outer surface of the nozzle housing and an inner surface of the combustion shield.

8. The method of claim 6, wherein the drain line is in flow communication with the circumferential gap at a location between ends of the circumferential gap.

9. A fuel injector, comprising:

an outer housing;

a nozzle housing disposed within the outer housing;

a flow path between the outer housing and the nozzle housing, the flow path being coupled to a low pressure fuel source;

a circumferential gap in flow communication with the flow path and extending along an upper surface of a combustion shield adjacent the injector tip; and an opening extending through the outer housing having one end in flow communication with the circumferential gap and another end in flow communication with a drain gap formed between the outer housing and a bore for receiving the fuel injector, the drain gap routing the low pressure fuel away from the injector tip.

10. The fuel injector of claim 9, wherein the nozzle housing comprises at least one injector orifice positioned at a distal end of the nozzle housing, the injector orifice being in flow communication with a high pressure fuel source to controllably inject fuel into a cylinder of an engine.

11. The fuel injector of claim 9, further comprising an O-ring disposed between the outer housing and the bore, the drain gap being disposed between the injector tip and the O-ring.

12. A method for cooling a fuel injector in a dual fuel engine application, comprising:

providing low pressure diesel fuel to a double walled segment coupled to a plurality of fuel injectors;

routing the low pressure diesel fuel from the double walled segment through a flow path between an injector nozzle housing and an injector outer housing;

routing the low pressure diesel fuel from the flow path through a circumferential gap extending along an upper surface of a combustion shield adjacent an injector tip; and draining the low pressure diesel fuel from the circumferential gap through a drain line coupled to a fuel tank.

13. The method of claim 12, wherein providing low pressure diesel fuel to a double walled segment comprises providing the low pressure fuel to an outer line of the double walled segment surrounding an inner line of the double walled segment.

14. The method of claim 13, further comprising providing high pressure fuel to the inner line of the double walled segment.

15. The method of claim 12, wherein routing the low pressure diesel fuel from the double walled segment through a flow path comprises routing the low pressure fuel from the double walled segment through a T-fitting coupled to one of the plurality of fuel injectors.

16. The method of claim 12, further comprising using a control module to control operation of the plurality of fuel injectors.

17. The method of claim 16, wherein using a control module to control operation of the plurality of fuel injectors comprises responding to an engine shut down when a fuel injector operating temperature is above a predetermined high temperature threshold by causing the flow of low pressure diesel fuel to the plurality of fuel injectors to discontinue.

18. The method of claim 16, wherein using a control module to control operation of the plurality of fuel injectors comprises responding to an engine shut down when a fuel injector operating temperature is above a predetermined high temperature threshold by activating a pumping device coupled to the circumferential gap to pump low pressure diesel fuel from the circumferential gap.

19. The method of claim 16, wherein using a control module to control operation of the plurality of fuel injectors comprises responding to an engine shut down when a fuel injector operating temperature is above a predetermined high temperature threshold by activating a pump for a period of time following engine shut down to pump low pressure diesel fuel through the circumferential gap to cool the injector tip.

20. The method of claim 16, wherein using a control module to control operation of the plurality of fuel injectors comprises responding to an engine shut down when a fuel injector operating temperature is above a predetermined high temperature threshold by causing the engine to idle for a period of time prior to actually shutting down the engine to permit the plurality of fuel injectors to cool before shut down.

21. The method of claim 20, wherein the period of time is one of a predetermined period of time or a period of time that depends upon a difference between the fuel injector operating temperature and the predetermined high temperature threshold.

22. A method for cooling a fuel injector, comprising:

using a control module to respond to an engine shut down when an operating temperature of a fuel injector of an engine is above a high temperature threshold by causing the engine to idle for a period of time prior to actually shutting down the engine to permit the fuel injector to cool before shut down.

23. The method of claim 22, wherein the period of time is one of a predetermined period of time or a period of time that depends upon a difference between the operating temperature and the high temperature threshold.

* * * * *